US007392726B2

(12) United States Patent
Nagata

(10) Patent No.: US 7,392,726 B2
(45) Date of Patent: Jul. 1, 2008

(54) RATCHET WRENCH AND METHOD OF ASSEMBLING THE SAME

(75) Inventor: Masakazu Nagata, Tokyo (JP)

(73) Assignee: KTS Co., Ltd., Tokyo (JP)

( * ) Notice: Subject to any disclaimer, the term of this patent is extended or adjusted under 35 U.S.C. 154(b) by 48 days.

(21) Appl. No.: 10/564,983

(22) PCT Filed: Jun. 8, 2004

(86) PCT No.: PCT/JP2004/007963

§ 371 (c)(1),
(2), (4) Date: Jun. 7, 2006

(87) PCT Pub. No.: WO2005/007346

PCT Pub. Date: Jan. 27, 2005

(65) Prior Publication Data

US 2006/0254393 A1 Nov. 16, 2006

(30) Foreign Application Priority Data

Jul. 18, 2003 (JP) ..... 2003-276744

(51) Int. Cl.
*B25B 13/46* (2006.01)

(52) U.S. Cl. ..... 81/57.39; 81/63

(58) Field of Classification Search ..... 81/57.39, 81/57.13, 57.29, 62, 63, 63.1, 63.2
See application file for complete search history.

(56) References Cited

U.S. PATENT DOCUMENTS

| | | | | |
|---|---|---|---|---|
| 4,699,028 | A * | 10/1987 | Bosque | 81/57.22 |
| 4,791,836 | A | 12/1988 | D'Haem et al. | |
| 5,896,789 | A | 4/1999 | Giardino | |
| 6,490,953 | B2 * | 12/2002 | Horvath | 81/57.39 |
| 2003/0150298 | A1 * | 8/2003 | Kusama | 81/57.39 |

FOREIGN PATENT DOCUMENTS

| | | |
|---|---|---|
| JP | 6-238574 | 8/1994 |
| JP | 2003-089070 | 3/2003 |

* cited by examiner

*Primary Examiner*—D. S Meislin
(74) *Attorney, Agent, or Firm*—Wenderoth, Lind & Ponack, L.L.P.

(57) ABSTRACT

In a ratchet wrench, a frictional force generation mechanism including a first guide bush and a disc spring is attached to a shank with a locking pin to form a shank assembly. Spring force of the disc spring acts only on the inside of the shank assembly. The shank assembly is inserted from a central space of a first annular hold portion toward a second annular hold portion, and the shank is held by an inner wall of the second annular hold portion. In the back side on which the shank assembly is inserted, the drop-out of the shank assembly from the central space side of the first annular hold portion is prevented by a snap ring attached to a groove of the first annular hold portion. With this arrangement, constant friction is applied to the shank.

12 Claims, 15 Drawing Sheets

FIG.12 - PRIOR ART
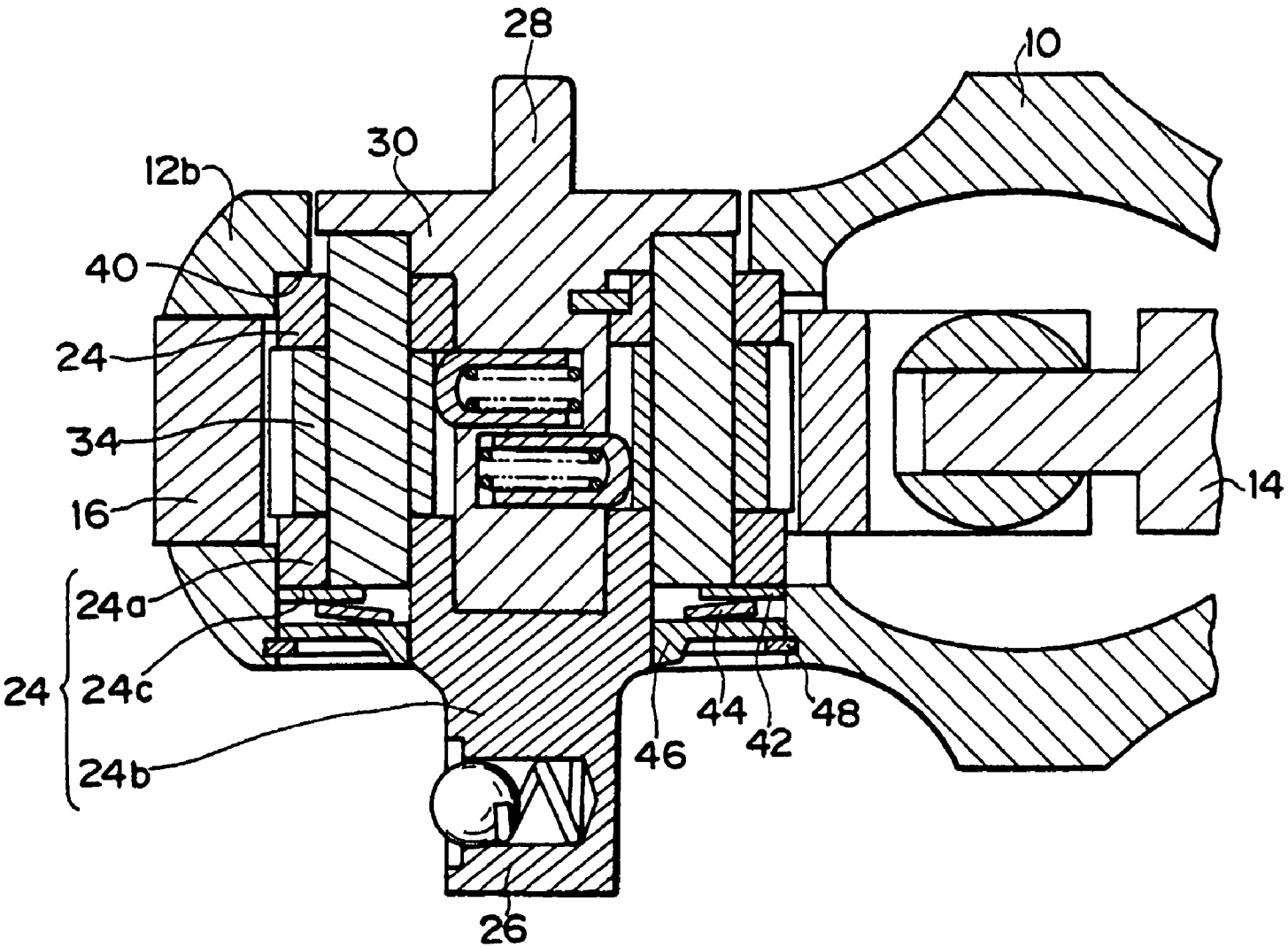

FIG.13 - PRIOR ART
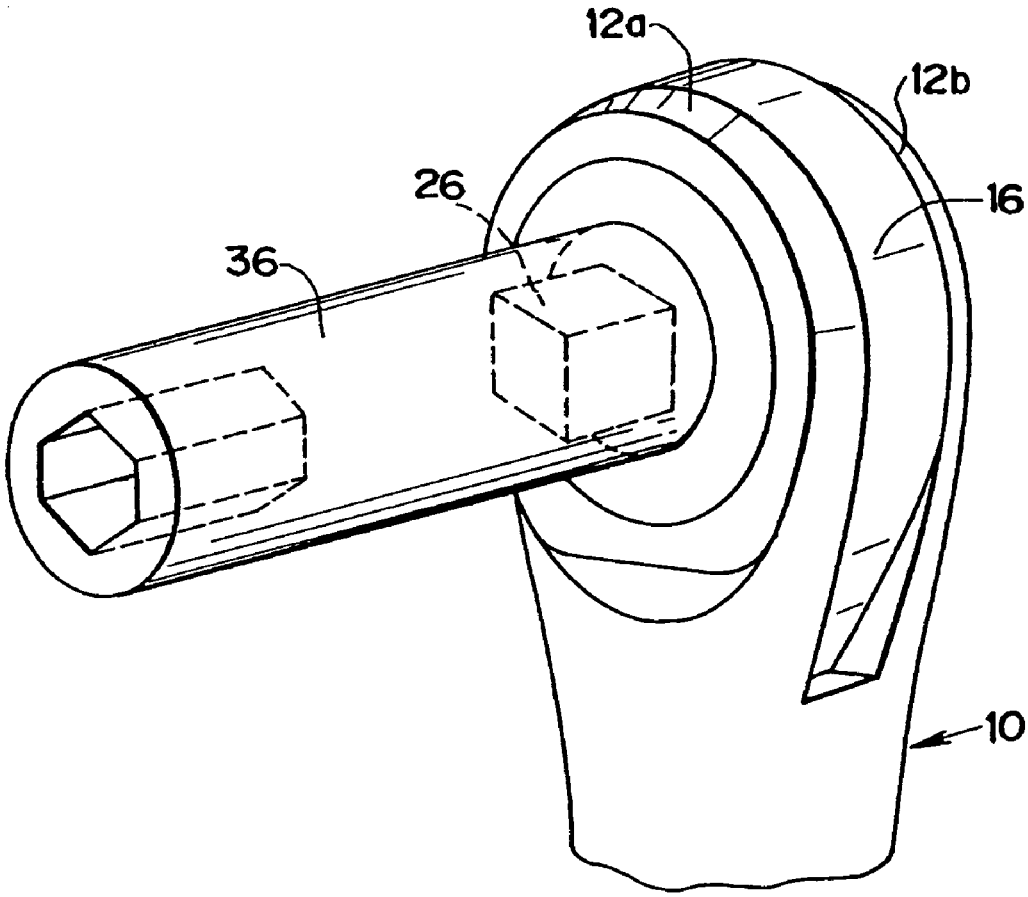

FIG.14 - PRIOR ART
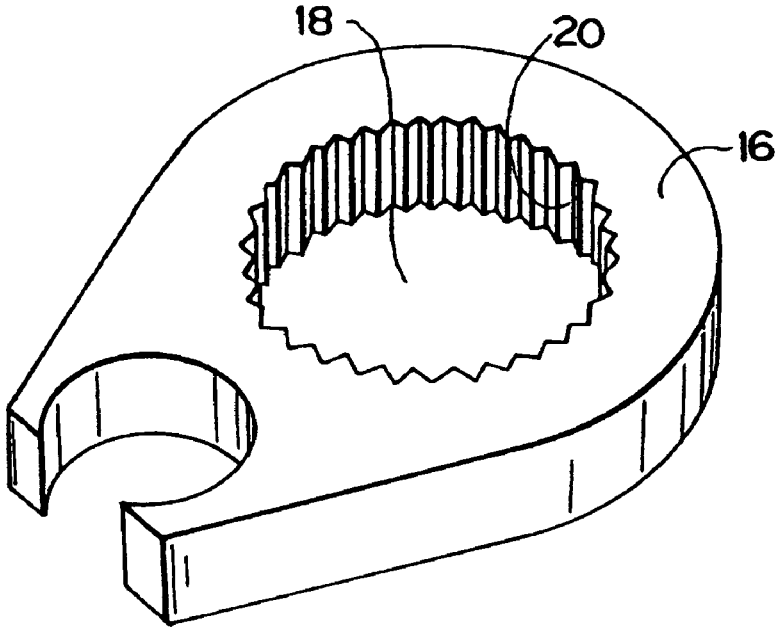
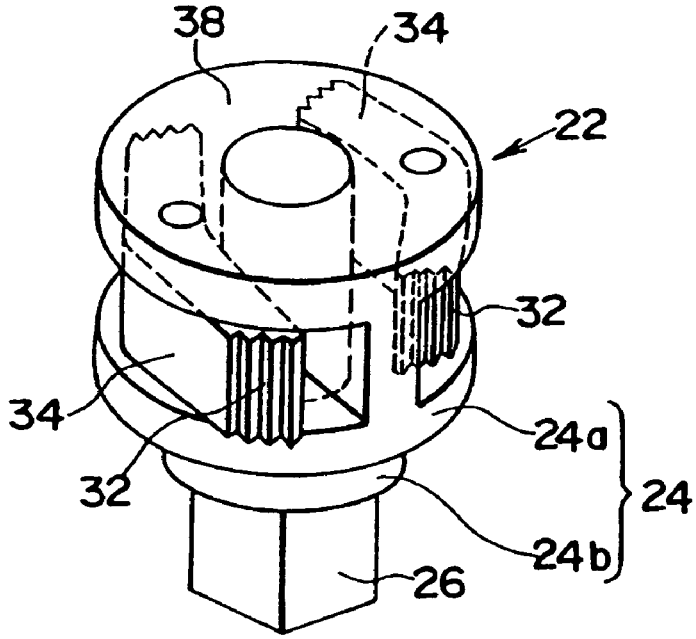

FIG.15 - PRIOR ART
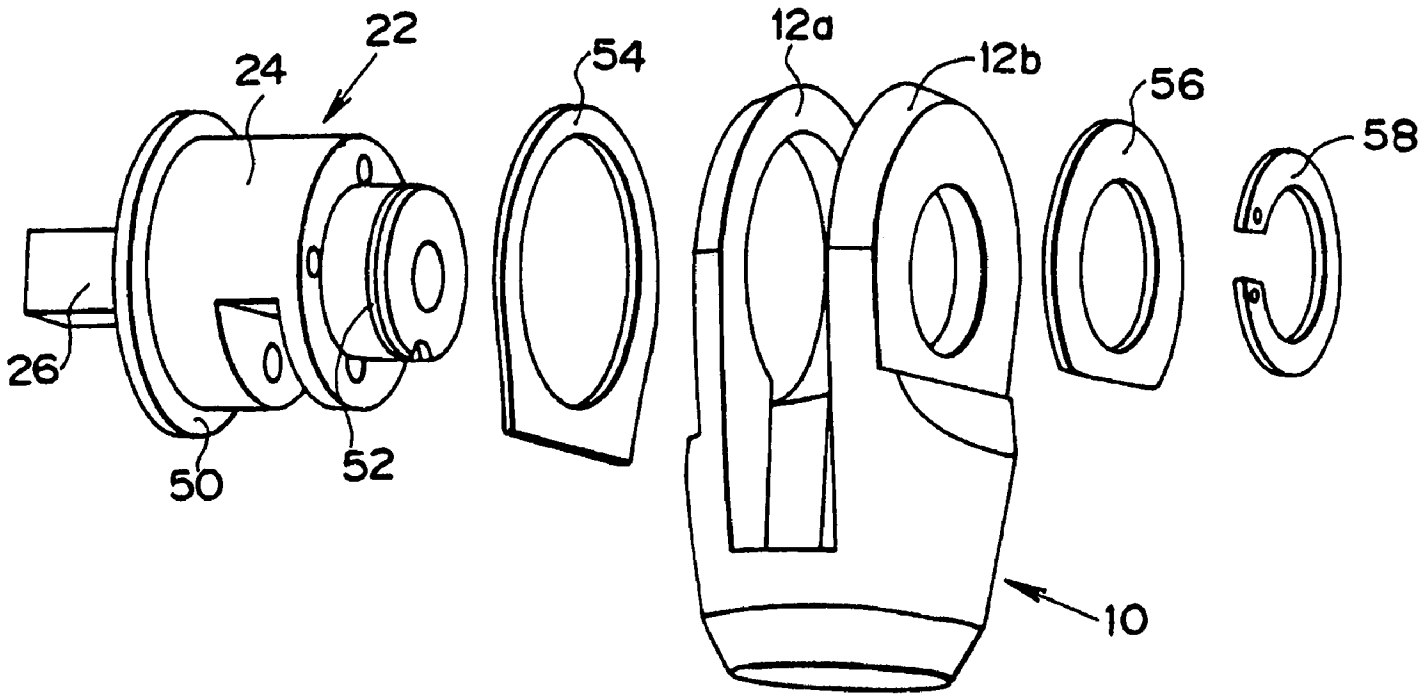

RATCHET WRENCH AND METHOD OF ASSEMBLING THE SAME

TECHNICAL FIELD

The present invention relates to a ratchet wrench used for fastening or loosening a bolt or a nut in assembly or disassembly of automobiles, industrial machinery, and the like and a method of assembling the ratchet wrench.

BACKGROUND ART

Conventionally an electric or manual ratchet wrench is used to securely and rapidly fasten and loosen a bolt, a nut, or the like. Conventional ratchet wrenches are shown in Patent Document 1, Patent Document 2, and the like. A main-part structure of the conventional ratchet wrench will be described with reference to FIGS. 12 to 14. As shown in FIGS. 12 and 13, a pair of annular hold portions including a first annular hold portion 12*a* and a second annular hold portion 12*b* is integrally formed at a front end of a housing 10. A crankshaft 14 is included in the housing 10, and the crankshaft 14 is rotated and reciprocally slid by a motor (not shown). An oscillation body 16 shown in FIG. 14 is included between the pair of annular hold portions 12*a* and 12*b*. A hole 18 is made in the center of the oscillation body 16, and an internal gear 20 is formed in an inner wall of the hole 18.

A shank 22 (FIG. 14) for intermittently rotating the bolt and the like is attached in the hole 18 in the center of the oscillation body 16. The shank 22 has a base portion 24, which includes a large-diameter portion 24*a* and a small-diameter portion 24*b*, and a cubic engagement portion 26 communicated with the small-diameter portion 24*b* side. A cylindrical switch button 30 to which a knob 28 is integrally formed is attached to the large-diameter portion 24*a*. Two wing members 34 are oscillatably included in a side face of the large-diameter portion 24*a* of the base portion 24, and plural pawls 32 are formed on both ends of the wing member 34. The large-diameter portion 24*a* of the base portion 24 is inserted into the hole 18 in the center of the oscillation body 16 to engage the pawls 32 of the wing members 34 with the internal gear 20 of the oscillation body 16.

In the ratchet wrench shown in FIGS. 12 to 14, the crankshaft 14 is rotated and reciprocally slid by driving the motor (not shown), which allows the oscillation body 16 to be reciprocally oscillated to intermittently rotate the shank 22 engaging with the oscillation body 16. One end of a socket 36 shown in FIG. 13 is engaged with the engagement portion 26 of the shank 22, and the bolt or the like (not shown) is engaged with the other end of the socket 36, which allows the bolt or the like to be intermittently fastened or loosened.

When the shank 22 is attached between the first annular hold portion 12*a* and the second annular hold portion 12*b*, first an upper surface 38 (FIG. 14) of the base portion 24 (large-diameter portion 24*a*) is put on the front end, the shank 22 is inserted via a central space of the first annular hold portion 12*a* toward the second annular hold portion 12*b*, and the upper surface 38 of the base portion 24 abuts on and is engaged with a step portion 40 provided in the inner wall of the second annular hold portion 12*b*.

A washer 42, a disc spring 44 as a spring, and an annular guide bush 46 are sequentially inserted from the engagement portion 26 toward the small-diameter portion 24*b* of the base portion 24, and the washer 42 is brought into contact with a step portion 24*c* (FIG. 12) at a boundary between the large-diameter portion 24*a* and the small-diameter portion 24*b* to fix a snap ring 48 to the first annular hold portion 12*a*. Therefore, the washer 42, the disc spring 44, and the guide bush 46 are sandwiched between the step portion 24*c* of the base portion 24 and the snap ring 48.

The disc spring 44 as the spring is intended to impart friction to the shank 22 and not to generate rattle in the shank 22 between the pair of annular hold portions 12*a* and 12*b*. The disc spring 44 biases the components that are in contact with both sides thereof toward the direction causing the components to be separated from each other, so that the step portion 24*c* of the base portion 24 and the snap ring 48 are biased in a direction away from each other. The shank 22 (base portion 24) is in contact with the second annular hold portion 12*b* and the snap ring 48 is fixed to the first annular hold portion 12*a*, so that the disc spring 44 applies the force in the direction causing the first annular hold portion 12*a* and the second annular hold portion 12*b* to be separated from each other.

Since the forces in the opposite directions are applied to the first annular hold portion 12*a* and the second annular hold portion 12*b* by the disc spring 44 respectively, a distance between the first annular hold portion 12*a* and the second annular hold portion 12*b* is increased by long-term use, which results in a drawback that the friction applied to the shank 22 is decreased.

A ratchet wrench which overcomes this drawback is shown in Patent Document 3, and a main-part structure thereof will be described with reference to FIG. 15. A flange 50 is formed at an end portion of the base portion 24 of the shank 22 on the engagement portion 26 side thereof, and a groove 52 is formed in an outer periphery near an end opposite to the engagement portion 26 of the base portion 24. In the case where the shank 22 is attached between the first annular hold portion 12*a* and the second annular hold portion 12*b*, the side on which the groove 52 of the base portion 24 is formed is put on the front end, the base portion 24 is inserted into the washer 54, and the washer 54 is brought into contact with the flange 50. Then, the base portion 24 of the shank 22 is inserted from the outside of the first annular hold portion 12*a* toward the second annular hold portion 12*b* side while the side on which the groove 52 is formed is put on the front end. The insertion of the base portion 24 is stopped while the washer 54 (flange 50) is in contact with an outside surface of the first annular hold portion 12*a*. In the state in which the insertion of the base portion 24 is stopped, a position of the groove 52 is protruded toward the outside from the second annular hold portion 12*b*. Then, a washer 56 is inserted into the base portion 24 from the outside of the second annular hold portion 12*b* to attach a snap ring 58 to the groove 52 of the base portion 24. The description of the biasing means for imparting the friction to the shank 22 will be omitted here.

In the ratchet wrench shown in FIG. 15, the outside surface of the first annular hold portion 12*a* and the outside surface of the second annular hold portion 12*b* are sandwiched between the flange 50 formed in the base portion 24 of the shank 22 and the snap ring 58 attached to the base portion 24. As a result, the increase in distance between the first annular hold portion 12*a* and the second annular hold portion 12*b* is prevented to prevent the decrease in friction acting on the shank 22.

Patent Document 1: Japanese Patent Laid-Open No. 2001-30179 (pages 2 to 3, FIGS. 14 to 16)

Patent Document 2: U.S. Pat. No. 5,537,899 (columns 4 to 5, FIGS. 3 and 4)

Patent Document 3: U.S. Pat. No. 6,490,953 (columns 4 to 5, FIG. 9)

In the ratchet wrench shown in FIG. 15, the sandwiching means for preventing the outward increase in distance between the pair of first annular hold portion 12*a* and second annular hold portion 12*b* is included in the outsides of the first annular hold portion 12*a* and the second annular hold portion 12*b*, which prevents the decrease in friction caused by the outward increase in distance between the first annular hold portion 12*a* and the second annular hold portion 12*b*. However, in the ratchet wrench in which the sandwiching means for preventing the outward increase in distance between the pair of annular hold portions 12*a* and 12*b* is included in the outsides of the pair of annular hold portions 12*a* and 12*b*, the friction applied to the shank 22 is excessively increased, which causes the drawback that a torque is not increased due to resistance at the start of the operation. Therefore, an operation lever is intermittently operated at the start of the operation to generate the desired torque after a while. Thus, in the ratchet wrench including the means for preventing the outward increase in distance between the pair of annular hold portions 12*a* and 12*b*, there is the drawback that working efficiency is worsened because the torque is not increased at the start of the operation.

DISCLOSURE OF THE INVENTION

An object of the invention is to provide a ratchet wrench which can always secure constant friction applied to the shank irrespective of the outward increase in distance between the pair of annular hold portions.

A ratchet wrench of the invention has a housing in which a pair of annular hold portions having central spaces is formed while separated from each other, a shank included between the pair of annular hold portions and having a base portion and an engagement portion, and a spring for imparting friction to the shank. The ratchet wrench is characterized in that the spring and a guide member protecting the spring are held in the shank by hold means to form one shank assembly, drop-out of the shank assembly from the central space of the other annular hold portion to an outside is prevented by a wall of the other annular hold portion, and drop-out preventing means for preventing the drop-out of the shank assembly from the central space of one of the annular hold portions to the outside is attached to one of the annular hold portions.

Further, the ratchet wrench of the invention is characterized in that an as-prepared material is used as the housing in which the pair of annular hold portions is formed, an annular recess portion is formed in an inner wall of the other annular hold portion, and an abrasion preventing member for obstructing contact between the shank and the other annular hold portion is placed in the annular recess portion. The ratchet wrench of the invention is characterized in that the abrasion preventing member is formed in an annular shape in which a hole is made in the center, a projection is formed in the shank, and the projection is fitted in the hole of the abrasion preventing member. The ratchet wrench of the invention is characterized in that rotation preventing means is placed between the abrasion preventing member and the other annular hold portion, and thereby the abrasion preventing member is not rotated with respect to the other annular hold portion. The ratchet wrench of the invention is characterized in that heat treatment is applied to the housing in which the pair of annular hold portions is formed, the annular recess portion is formed in the inner wall of the other annular hold portion, and the shank is fitted in the annular recess portion to bring the shank into direct contact with the other annular hold portion. The ratchet wrench of the invention is characterized in that an annular groove is formed in an opposing surface facing the central space in one of the annular hold portions, and a snap ring fitted in the annular groove is used as the drop-out preventing means. The ratchet wrench of the invention is characterized in that the rotation preventing means is placed between the guide member and the inner wall of one of the annular hold portions, and thereby the guide member is not rotated with respect to the other annular hold portion. The ratchet wrench of the invention is characterized in that the guide member has an inner-side cylindrical portion, an outer-side cylindrical portion and an annular space portion therebetween, and the spring is accommodated in the annular space portion. The ratchet wrench of the invention is characterized in that a washer is included between the shank and the guide member, and a washer is included between the spring and the hold means. The ratchet wrench of the invention is characterized in that the spring is formed in an annular disc spring or a wave spring. The ratchet wrench of the invention is characterized in that the hold means is configured so as not to be protruded to the outside from an outer surface of any one of the annular hold portions.

In a ratchet wrench having a housing in which a pair of annular hold portions having central spaces is formed while separated from each other and a shank included between the pair of annular hold portions and having a base portion and an engagement portion, a ratchet wrench assembly method of the invention is characterized by including the steps of forming one shank assembly by holding a spring imparting friction to the shank and a guide member protecting the spring in the shank with hold means; inserting the shank assembly from a central space of one of the annular hold portions toward the other annular hold portion; obstructing drop-out of the shank assembly from the central space of the other annular hold portion by an inner wall of the other annular hold portion; and attaching drop-out preventing means for preventing the drop-out of the shank assembly from the central space of one of the annular hold portions toward an opposite direction to the insertion direction of the shank assembly to one of the annular hold portions.

Further, the ratchet wrench assembly method of the invention is characterized in that an as-prepared material is used as the housing in which the pair of annular hold portions is formed, an annular recess portion is formed in an inner wall of the other annular hold portion, an abrasion preventing member in which a hole is made in the center and for obstructing contact between the shank and the other annular hold portion is placed in the annular recess portion, a projection is formed in the shank, and the projection is fitted in the hole of the abrasion preventing member. The ratchet wrench assembly method of the invention is characterized in that rotation preventing means is placed between the abrasion preventing member and the other annular hold portion, and thereby the abrasion preventing member is not rotated with respect to the other annular hold portion. The ratchet wrench assembly method of the invention is characterized in that heat treatment is applied to the housing in which the pair of annular hold portions is formed, the annular recess portion is formed in the inner wall of the other annular hold portion, and the shank is fitted in the annular recess portion to bring the shank into direct contact with the other annular hold portion. The ratchet wrench assembly method of the invention is characterized in that an annular groove is formed in an opposing surface facing the central space in one of the annular hold portions, and a snap ring fitted in the annular groove is used as the drop-out preventing means. The ratchet wrench assembly method of the invention is characterized in that the rotation preventing means is placed between the guide member and the inner wall of one of the annular hold portions, and thereby the guide member is not rotated with respect to the other annular hold portion. The ratchet wrench assembly method of the invention is characterized in that the guide member has an inner-side cylindrical portion, an outer-side cylindrical portion and an annular space portion therebetween, and the spring is accommodated in the annular space portion. The ratchet wrench assembly method of the invention is characterized in that a washer is included between the shank and the guide member, and a washer is included between the spring and the hold means. The ratchet wrench assembly method of the invention is characterized in that the spring is formed in an annular disc spring or a wave spring. The ratchet wrench assembly method of the invention is characterized in that the hold means is configured so as not to be protruded to the outside from an outer surface of any one of the annular hold portions.

The shank assembly as the one assembly is formed by attaching the spring for imparting the friction to the shank, the guide member for protecting the spring, and the washer to the shank with the hold means. The pressing force of the spring acts not on the outside of the shank assembly, but only on the shank of the shank assembly and the hold means. Therefore, the pressing force of the spring does not act on the pair of annular hold portions, and the force in the direction in which the distance between the pair of annular hold portions is outwardly increased is not applied to them unlike the conventional art. The pressing force of the spring is received inside the shank assembly, and it does not have an influence on the outside of the shank assembly. Therefore, the friction applied to the shank is kept constant, and the problem that the torque is not applied at the start of the operation can be eliminated.

The shank assembly is inserted from the central space of one of the annular hold portions toward the other annular hold portion, and the shank assembly is abutted on and held by the inner wall of the other annular hold portion. Then, the snap ring is attached to one of the annular hold portions to obstruct the drop-out of the shank assembly from the central space thereof. Thus, since the assembly of the ratchet wrench is such a simple operation in which the shank assembly is inserted and the snap ring is attached to one of the annular hold portions, the working hours can be shortened to achieve cost reduction.

BRIEF DESCRIPTION OF THE DRAWINGS

FIG. 2 is assembled;

FIG. 12 is a main-part sectional view showing a conventional ratchet wrench;

FIG. 13 is a perspective view showing a state in which a socket is attached to the conventional ratchet wrench;

FIG. 14 is a perspective view showing an oscillation body and a shank used for the ratchet wrench of FIG. 12; and FIG. 15 is an exploded perspective view showing another conventional shank.

DETAILED DESCRIPTION OF THE INVENTION

In a ratchet wrench of the invention, the friction acting on the shank is kept constant irrespective of the outward increase in distance between a pair of annular hold portions. The invention will be described below with reference to the drawings.

First Embodiment

Figure 1:
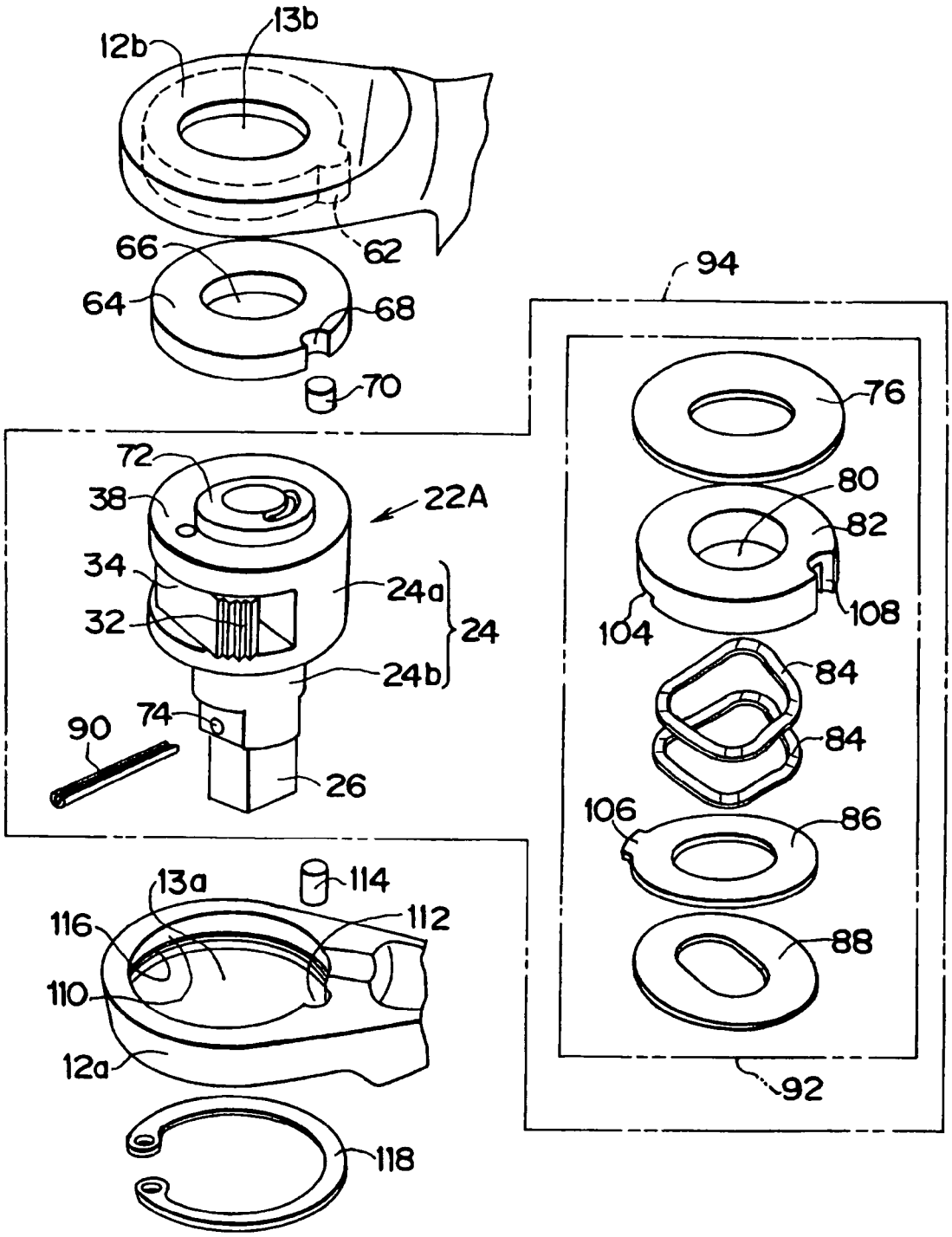
FIG. 1 is an exploded perspective view showing an embodiment of a ratchet wrench according to the invention.
Figure 2:
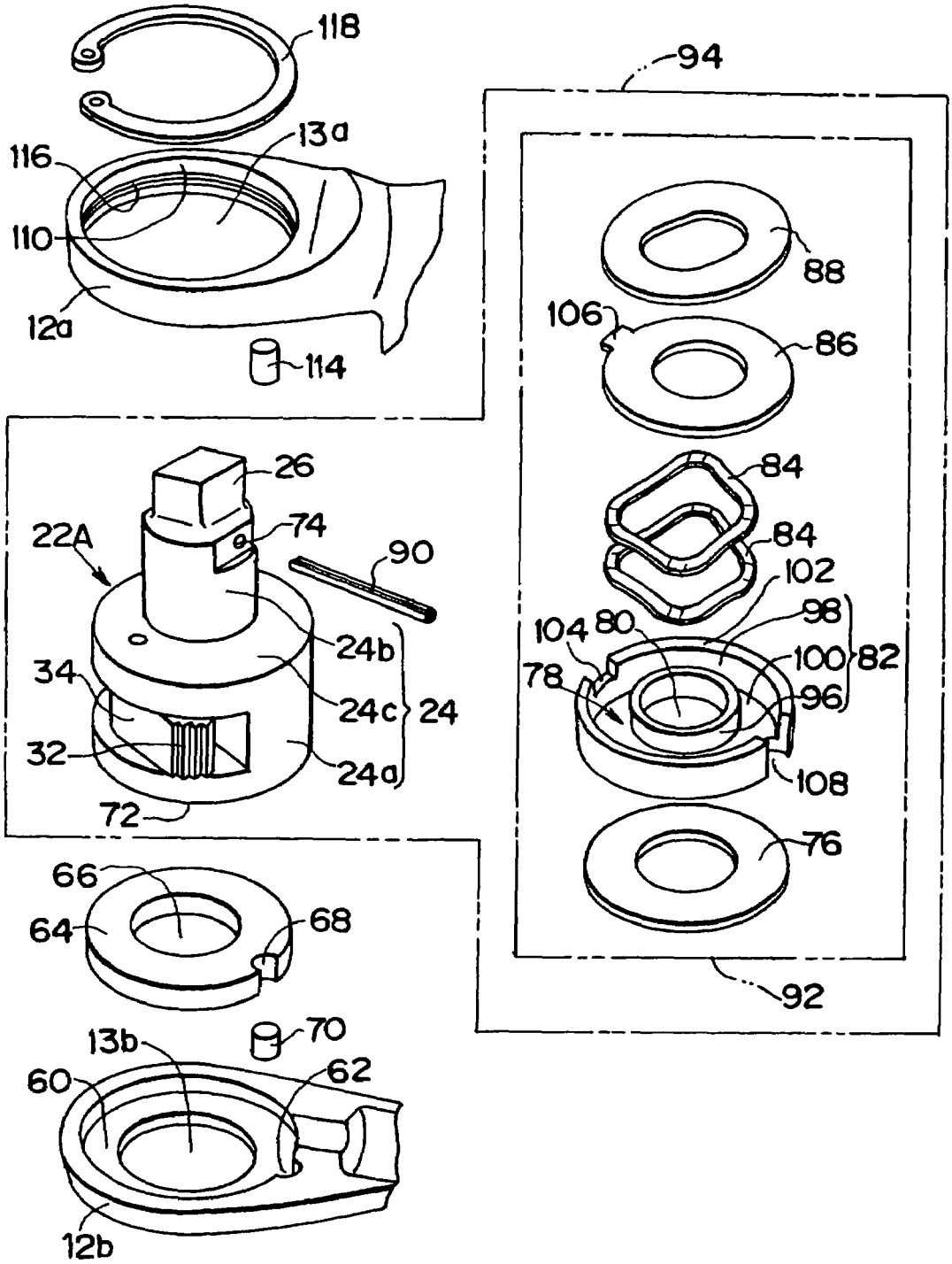
FIG. 2 is an exploded perspective view of the ratchet wrench of FIG. 1 when viewed from an opposite side of FIG. 1.
Figure 3:
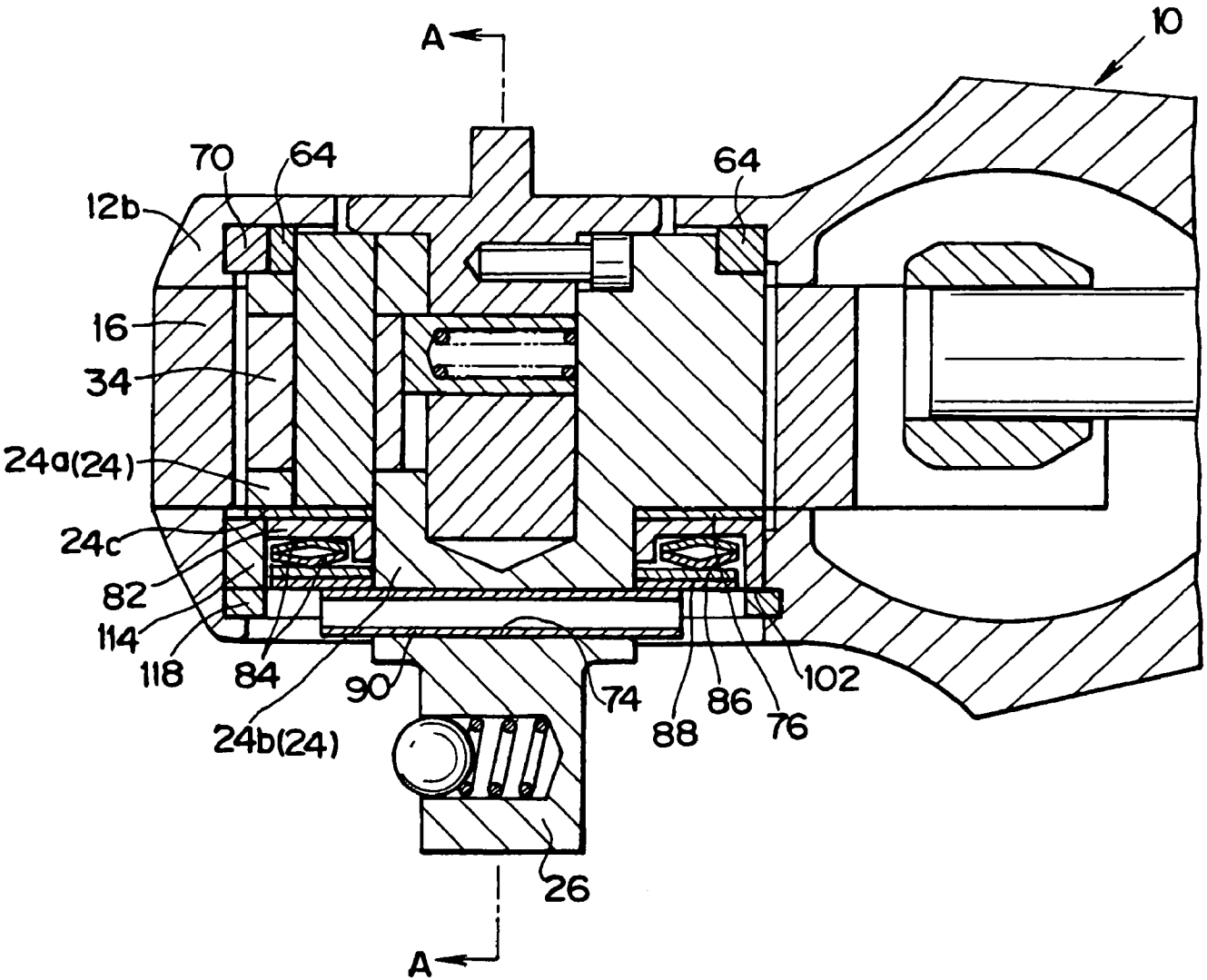
FIG. 3 is a sectional view showing a state in which the ratchet wrench of FIG. 1
Figure 4:
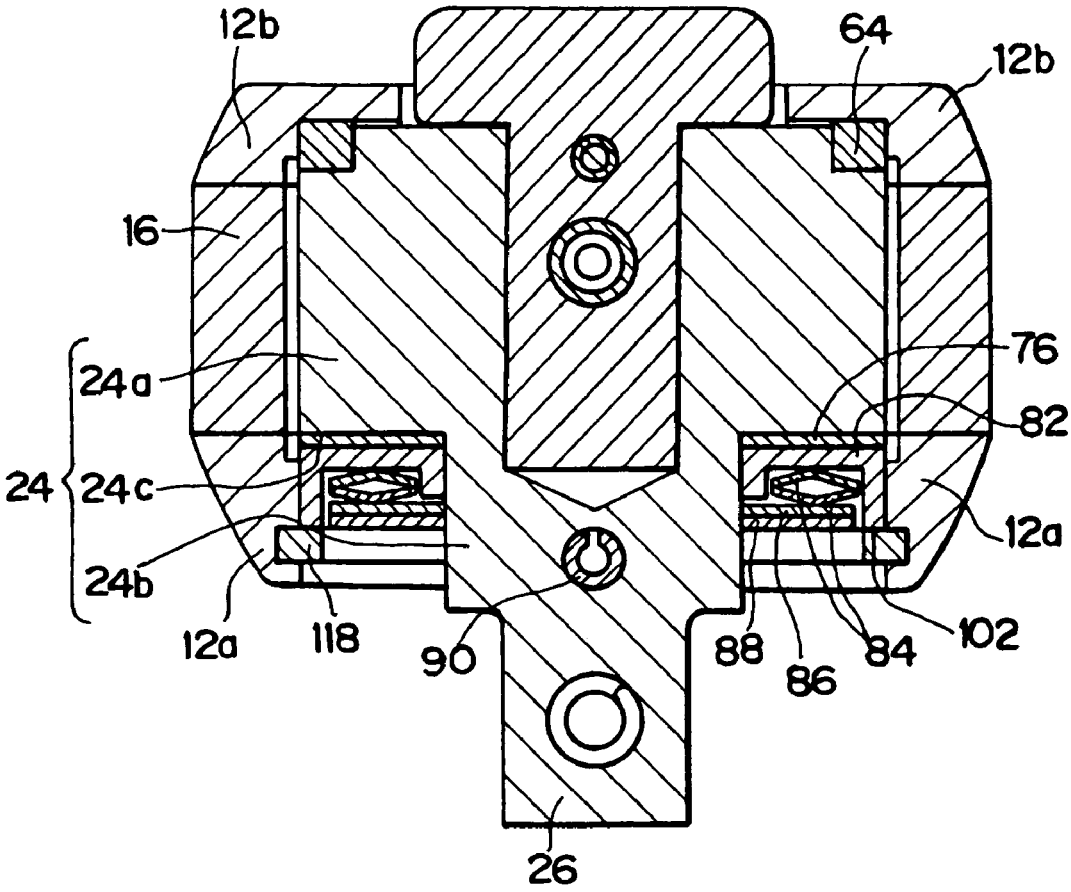
FIG. 4 is a sectional view taken on line A-A of FIG. 3.

FIG. 1 is an exploded perspective view of a main part of the ratchet wrench according to the invention, FIG. 2 is an exploded perspective view of the ratchet wrench of FIG. 1 when viewed from an opposite side of FIG. 1, FIG. 3 is a main-part sectional view showing a state in which the ratchet wrench of FIG. 1 and FIG. 2 is assembled, and FIG. 4 is a sectional view taken on line A-A of FIG. 3. In FIGS. 1 to 4, the same components as in FIGS. 12 to 14 are designated by the same reference numerals. In a first embodiment, as-prepared material to which heat treatment such as quenching and annealing is not performed is used as a housing 10 including a first annular hold portion 12*a* and a second annular hold portion 12*b*. A first central space 13*a* is formed in the center of the first annular hold portion 12*a*, and a second central space 13*b* is formed in the center of the second annular hold portion 12*b*. An annular recess portion 60 is formed in an inner wall of the second annular hold portion 12*b*, and a substantially-semi-cylindrical fitting recess portion 62 is formed at one point of a rim of the recess portion 60 (FIG. 2). A second guide bush 64 as an abrasion preventing member is fitted in and attached to the annular recess portion 60. The second guide bush 64 has an annular shape in which a hole 66 is made in the center, and a substantially-semi-cylindrical fitting recess portion 68 is vertically formed in an outer periphery side face of the second guide bush 64. A rotation locking pin 70 as rotation preventing means is fitted in the fitting recess portion 62 of the second annular hold portion 12*b* and the fitting recess portion 68 of the guide bush 64. Therefore, the second guide bush 64 is held in a non-rotating state with respect to the second annular hold portion 12*b*.

A shank 22A has a base portion 24, an engagement portion 26, and a wing member 34 including a pawl 32. The base portion 24 includes a large-diameter portion 24*a*, which includes a wing member 34, and a small-diameter portion 24*b* connecting the large-diameter portion 24*a* and the engagement portion 26. A step portion 24*c* is formed at a boundary between the large-diameter portion 24*a* and the small-diameter portion 24*b*. A cylindrical projection 72 is integrally formed in the center of an upper surface 38 of the large-diameter portion 24*a* of the base portion 24. A through-hole 74 is made in a direction perpendicular to a shaft direction at a position near the engagement portion 26 in the small-diameter portion 24*b* of the base portion 24.

In the shank 22A, an annular first washer 76 as the abrasion preventing member, a first guide bush 82 as a guide member having an annular space portion 78 and a central through-hole 80, one or plural disc springs 84 as a spring accommodated in the space portion 78, an annular second washer 86 as the abrasion preventing member, and an annular third washer 88 as the abrasion preventing member are inserted from the engagement portion 26 toward the small-diameter portion 24*b* of the base portion 24, and a locking pin 90 as a hold means is inserted into and fixed to through-hole 74 made in the base portion 24 of the shank 22A. The first guide bush 82 as the guide member prevents the disc spring 84 as the spring from rotating along with the shank 22A and it is desirably formed by the abrasion preventing member. Heat treatment such as quenching is desirably applied to the first guide bush 82 and the second guide bush 64 because they support the shank 22A.

In the state in which the locking pin 90 is inserted into and fixed to the through-hole 74 of the base portion 24 of the shank 22A, the first washer 76, the first guide bush 82, the disc spring 84, the second washer 86, and the third washer 88 are sandwiched between the step portion 24*c* of the base portion 24 and the locking pin 90. "The first washer 76, the first guide bush 82, the one or plural disc springs 84, the second washer 86, and the third washer 88" which are sandwiched between the shank 22A and the locking pin 90 together form a frictional force generation means 92. An assembly, in which the frictional force generation means 92 is held in the shank 22A by the locking pin 90 so as not to be unlocked, constitutes a shank assembly 94.

The disc spring 84 biases the components that are in contact with both sides of the disc spring 84 toward the direction causing the components to be separated from each other. Places where biasing force of the disc spring 84 is finally received are the base portion 24 (step portion 24*c*) of the shank 22A and the locking pin 90 inserted into and fixed to the base portion 24 of the shank 22A. That is, the force generated by the disc spring(s) 84 acts on the inside of the shank assembly 94 while the force does not act on the outside of the shank assembly 94. Although the one or plural disc springs 84 are used as the spring for imparting the friction to the shank 22A, the spring is not limited to the disc spring 84. When the ring-shaped spring such as a disc spring and a wave spring is used as the spring, a height of the shank assembly 94 can be decreased, and the shank assembly 94 can be easily accommodated in the space portion 78 of the first guide bush 82.

As shown in FIG. 2, the first guide bush 82 comprises an inner-side cylindrical portion 96, an outer-side cylindrical portion 98, and an annular closed end face 100 which connects one end of the inner-side cylindrical portion 96 and one end of the outer-side cylindrical portion 98. The through-hole 80 is made inside the inner-side cylindrical portion 96, and the annular space portion 78 is formed by the outside surface of the inner-side cylindrical portion 96, the inside surface of the outer-side cylindrical portion 98, and one of surfaces of the closed end face 100. The small-diameter portion 24*b* of the base portion 24 of the shank 22A is inserted into the through-hole 80, the one or plural disc springs 84 are accommodated in the annular space portion 78. A notch 104 is formed at one point of a free end-face 102 on an insertion rear end side of the outer-side cylindrical portion 98. A projection tongue portion 106 is integrally formed in the outer rim of the second washer 86, the projection tongue portion 106 of the second washer 86 is engaged in the notch 104 of the first guide bush 82. This engagement enables the second washer 86 to be a cover of the space portion 78 in which the disc spring 84 is accommodated. The second washer 86 is never rotated with respect to the first guide bush 82.

A semi-cylindrical fitting recess portion 108 is formed at one point of the outer-side cylindrical portion 98 of the first guide bush 82. A fitting recess portion 112 (FIG. 1) which is the semi-cylindrical space is also formed in an opposing wall 110 facing the first central space 13*a* of the first annular hold portion 12*a*. Further, an annular groove 116 is formed in the opposing wall 110 of the first annular hold portion 12*a*.

In the case where the shank assembly 94 is attached between the first annular hold portion 12*a* and the second annular hold portion 12*b*, while the projection 72 side of the shank 22A is put on the front end and the engagement portion 26 is put on the rear end, the shank assembly 94 is inserted from the first annular hold portion 12*a* (from the position near the engagement portion 26 in the assembled state) toward the second annular hold portion 12*b* (from the position far way from the engagement portion 26 in the assembled state), and the projection 72 of the shank 22A is fitted in the hole 66 of the second guide bush 64. In the sate in which the projection 72 of the shank 22A is fitted in the hole 66 of the second guide bush 64, the shank 22A is configured to be in contact with the second guide bush 64 while not being in direct contact with the second annular hold portion 12*b*. In this state, the shank 22A is rotatable relative to the second guide bush 64.

Before the shank assembly 94 is inserted from the first annular hold portion 12*a* toward the second annular hold portion 12*b*, a rotation locking pin 114 as the rotation preventing means is previously fitted in the fitting recess portion 108 of the first guide bush 82. In inserting the shank assembly 94, the rotation locking pin 114 is fitted in the fitting recess portion 112 of the first annular hold portion 12*a*. Therefore, the first guide bush 82 (the disc spring 84 and the second washer 86) is held to be non-rotatable with respect to the first annular hold portion 12*a*.

A snap ring 118 as the drop-out preventing means is attached to the groove 116 of the first annular hold portion 12*a* while the upper surface 38 of the base portion 24 in the shank assembly 94 is pressed against the second guide bush 64. In the state in which the snap ring 118 is attached to the groove 116 of the first annular hold portion 12*a*, as shown in FIGS. 3 and 4, the free end-face 102 of the outer-side cylindrical portion 98 of the first guide bush 82 comes into contact with the side face of the snap ring 118, so that the shank assembly 94 never drops out from the central space 13*a* of the first annular hold portion 12*a* to the outside. That is, in the shank assembly 94, one side abuts on and is held in the inner wall of the second annular hold portion 12*b* through the second guide bush 64 (state in which the drop-out of the shank assembly 94 from the central space 13*a* to the outside is prevented), and the other side is configured not to drop out from the central space 13*a* of the first annular hold portion 12*a* to the outside by the snap ring 118 attached to the groove 116 of the first annular hold portion 12*a*. Therefore, the shank assembly 94 is held between the annular hold portion 12*a* and the second annular hold portion 12*b* while not dropping out.

In the state in which the snap ring 118 is attached to the groove 116 of the first annular hold portion 12*a*, since the rotation locking pin 114 is fitted in the fitting recess portion 108 of the first guide bush 82 and the fitting recess portion 112 of the first annular hold portion 12*a*, the first guide bush 82 (the disc spring 84 and the second washer 86) is never rotated. The shank 22A and the locking pin 90 fixed thereto are rotated through the first washer 76 and the third washer 88 with respect to the first guide bush 82 and the first annular hold portion 12*a*. In the rotation of the shank 22A and the locking pin 90, the force by the disc spring 84 acts on the shank 22A and the locking pin 90 as the friction through the first washer 76 and the third washer 88. In the state in which the snap ring 118 is attached to the groove 116 of the first annular hold portion 12*a*, the locking pin 90 of the shank assembly 94 is set so as not to fly out from the outer surface of the first annular hold portion 12*a* to the outside.

In the invention having the above-described configuration, the frictional force generation means 92 is attached to the shank 22A with the locking pin 90 to form the shank assembly 94, and the shank assembly 94 is attached between the first annular hold portion 12*a* and the second annular hold portion 12*b* so as not to drop out. Since the frictional force generation means 92 is attached to the first annular hold portion 12*a* with the rotation locking pin 114, the frictional force generation means 92 is not rotated with respect to the first annular hold portion 12*a* and the second annular hold portion 12*b*, and the shank 22A and the locking pin 90 are rotated with respect to the first annular hold portion 12*a* and the second annular hold portion 12*b*.

In the invention, since the spring (the disc spring 84) imparting the friction to the shank 22A is included as an inside part of the shank assembly 94, the pressing force by the spring never acts on the outside. That is, in the invention, because the friction is kept constant, the conventional drawback that the torque is weakend at the start of the operation can be eliminated. Further, in the invention, the force applied in the direction in which the first annular hold portion 12*a* and the second annular hold portion 12*b* are opened away from each other does not act on them, so that the friction is not influenced by the distance between the first annular hold portion 12*a* and the second annular hold portion 12*b*. Therefore, it is not necessary to consider the distance between the first annular hold portion 12*a* and the second annular hold portion 12*b*, and a degree of freedom is obtained in the design.

In the invention, the shank 22A is supported by the inner wall of the hole 66 of the second guide bush 64 and the inner walls of the first guide bush 82 and the inner-side cylindrical portion 96 of the second guide bush 64. The first washer 76 is placed between the rotating shank 22A and the not-rotating second guide bush 64. Therefore, only the second guide bush 64, the first guide bush 82, and the first washer 76 can be formed by the member which is replaced due to the abrasion. Consequently, the replacement is simple, and cost of the replacement part can be reduced.

In the invention, when the ratchet wrench is assembled, the shank assembly 94 is inserted from the central space 13*a* of the first annular hold portion 12*a* toward the second annular hold portion 12*b*, and the shank assembly 94 is directly or indirectly held in the inner wall of the second annular hold portion 12*b* (the shank assembly 94 is configured so as not to drop out from the inside to the outside through the central space 13*b*). Then, the snap ring 118 is attached to the groove 116 of the first annular hold portion 12*a* such that the rear side in the insertion direction of the shank assembly 94 does not drop out from the central space 13*a* of the first annular hold portion 12*a*. In this assembly method, after the shank assembly 94 is inserted from the first annular hold portion 12*a* toward the second annular hold portion 12*b*, only the snap ring 118 is attached to the first annular hold portion 12*a*. Therefore, the assembly work can be simply performed in a short time.

In the first embodiment, the as-prepared material to which the heat treatment is not performed is used as the housing 10 including the first annular hold portion 12*a* and the second annular hold portion 12*b*. When compared with the material to which the heat treatment is performed, high dimensional accuracy can be obtained by using the as-prepared material to which the heat treatment is not performed.

As described above, the frictional force generation means 92 comprises the first washer 76, the first guide bush 82, the disc spring 84, the second washer 86, and the third washer 88. However, the frictional force generation means 92 may be used as long as the first guide bush 82, which prevents the rotation with respect to the first annular hold portion 12*a* and the second annular hold portion 12*b* while preventing the rotation of the disc spring 84, and the disc spring 84 as the spring imparting the friction to the shank 22A are included. The space portion 78 is provided in the first guide bush 82 to accommodate the one or plural disc springs 84 in the space portion 78, and the space portion 78 is desirably closed by the second washer 86. The frictional force generation means 92 desirably includes the first washer 76 between the first guide bush 82 and the shank 22A and the third washer 88 between the disc spring 84 (second washer 86) and the locking pin 90.

Second Embodiment

A second embodiment of the invention will be described below with reference to FIGS. 5 and 6.

Figure 5:
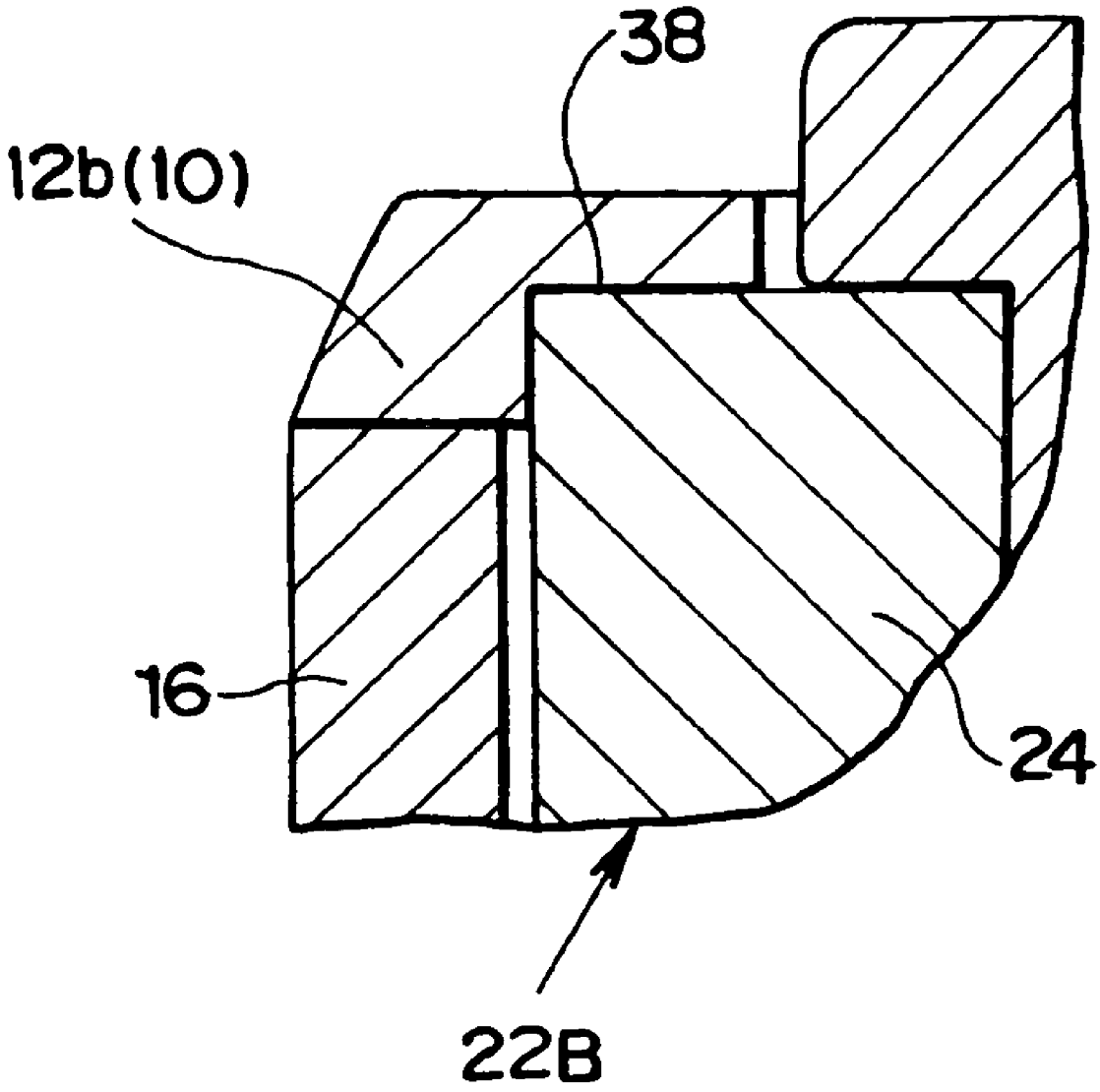
FIG. 5 is a main-part sectional view showing another embodiment of a ratchet wrench according to the invention.
Figure 6:
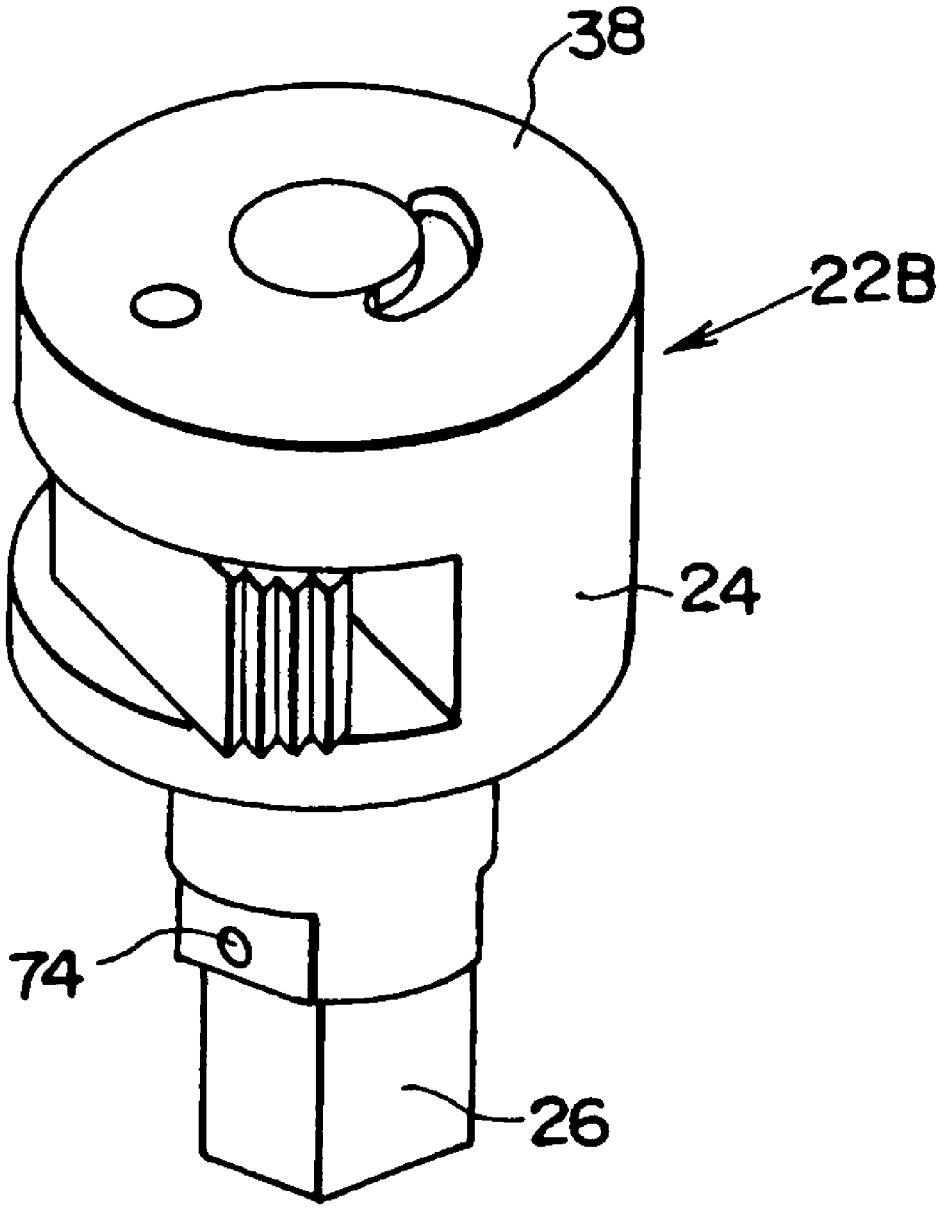
FIG. 6 is a perspective view showing a shank used in FIG. 5.

In FIGS. 5 and 6, the same components as those shown in FIGS. 1 to 4 are designated by the same reference numerals. In the second embodiment, the material to which the heat treatment such as quenching and annealing is applied is used as the housing 10 including the first annular hold portion 12*a* and the second annular hold portion 12*b*. Since the material to which the heat treatment is applied is used as the first annular hold portion 12*a* and the second annular hold portion 12*b*, the upper surface 38 of a shank 22B may be brought into direct contact with the second annular hold portion 12*b*. Therefore, the second guide bush 64 used in the first embodiment will be omitted. Since the second guide bush 64 is omitted, in the shank 22B, a height of the base portion 24 is increased to be higher than a height of the base portion 24 of the shank 22A in order to fit to the distance between the first annular hold portion 12*a* and the second annular hold portion 12*b*. The first embodiment differs from the second embodiment only in that the heat treatment of the housing 10 is present or absent and whether the shank 22B is brought into direct contact with the second annular hold portion 12*b* or the shank 22A is brought into contact with the second annular hold portion 12*b* through the second guide bush 64. Accordingly, in the second embodiment, the same effect as the first embodiment is obtained except for the difference in effect based on the heat treatment of the housing 10.

In the second embodiment, since the second guide bush 64 can be omitted, the height of the base portion 24 of the shank 22B can be decreased to be lower than the height of the base portion 24 of the shank 22A (can be decreased by the height of the projection 72 of the shank 22A). As a result, the distance between the first annular hold portion 12*a* and the second annular hold portion 12*b* is narrowed to miniaturize the housing 10, which enables the overall weight of the ratchet wrench to be reduced.

Third Embodiment

Figure 7:
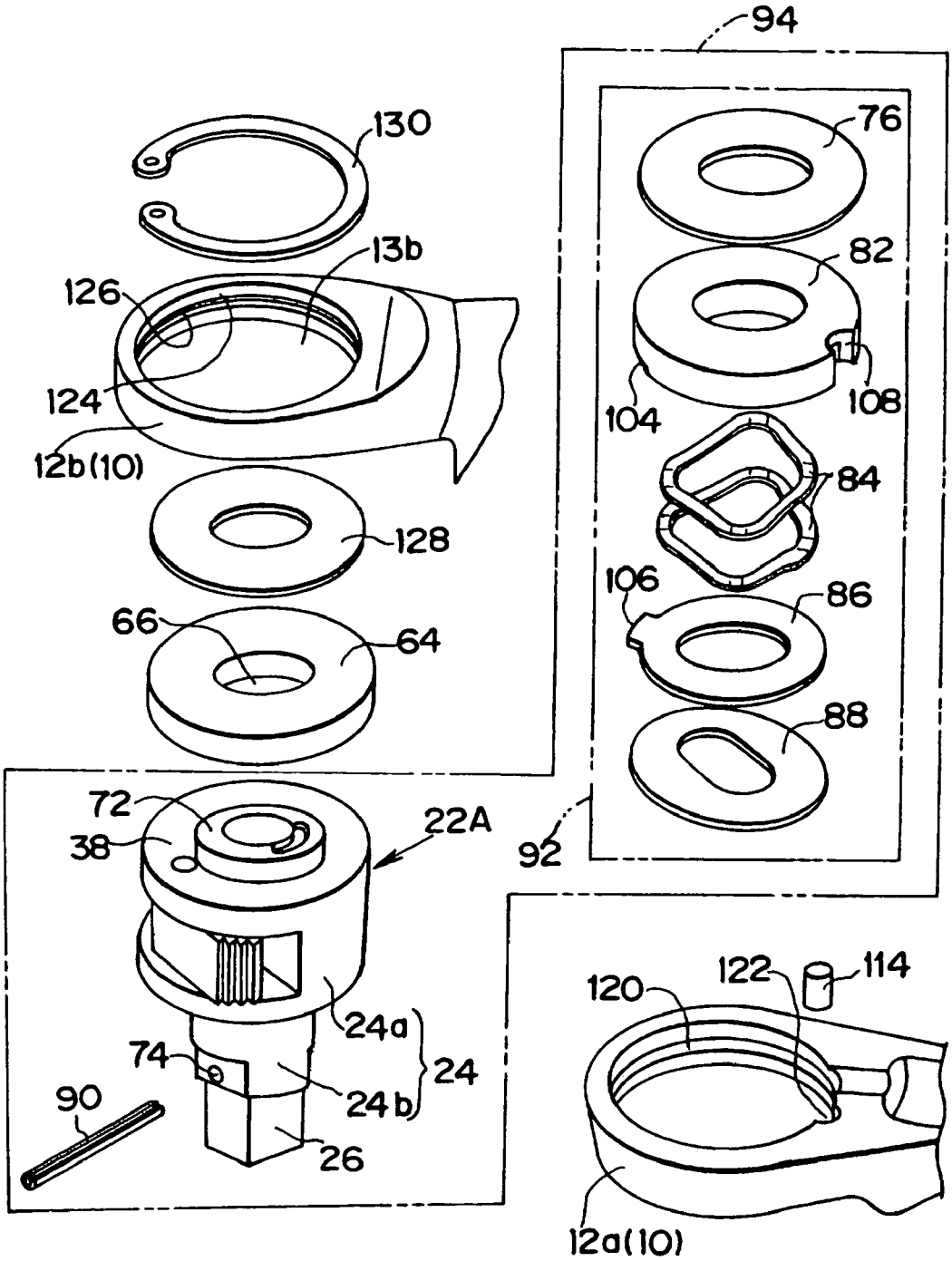
FIG. 7 is an exploded perspective view showing another embodiment of a ratchet wrench according to the invention.
Figure 8:
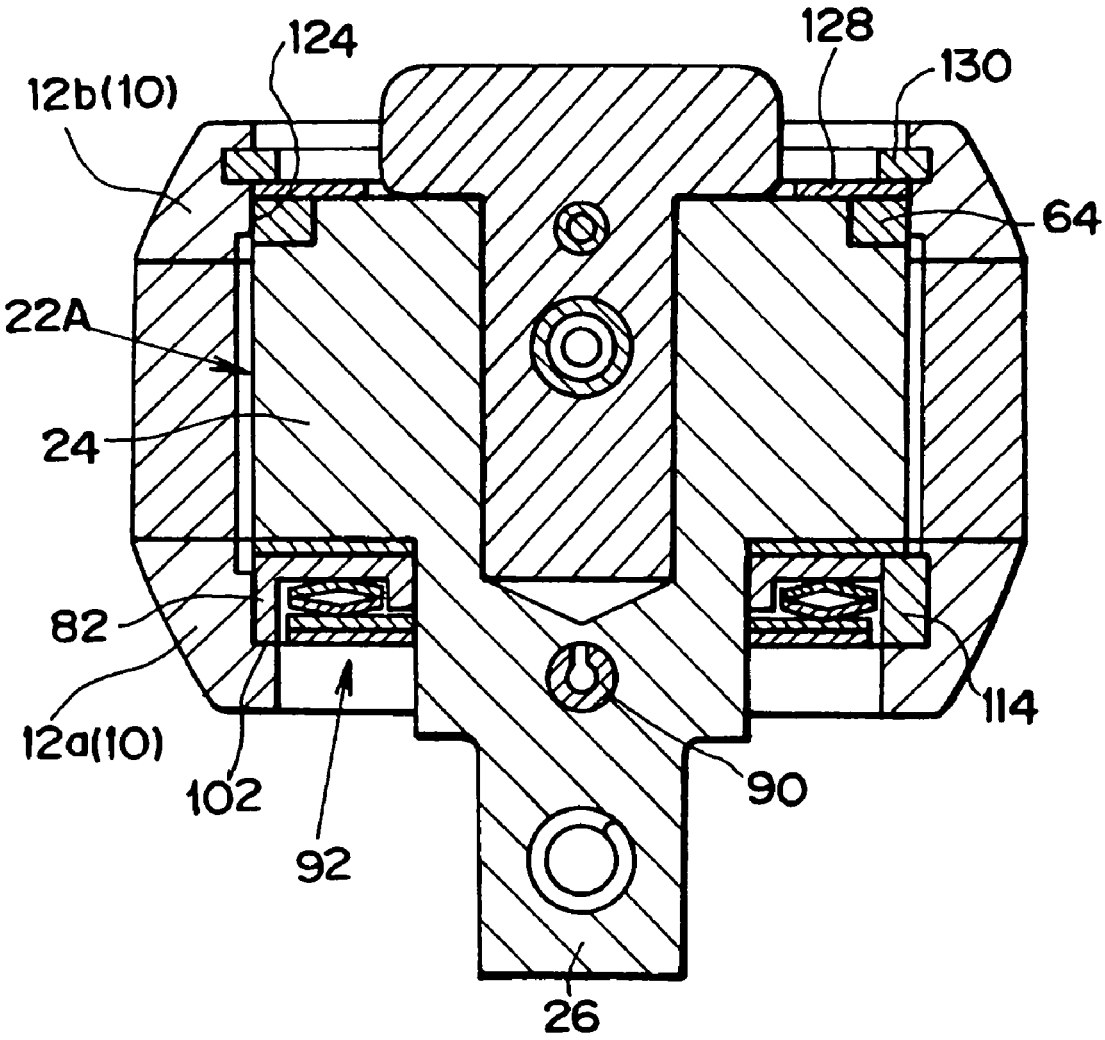
FIG. 8 is a sectional view showing a state in which the ratchet wrench of FIG. 7 is assembled.
Figure 9:
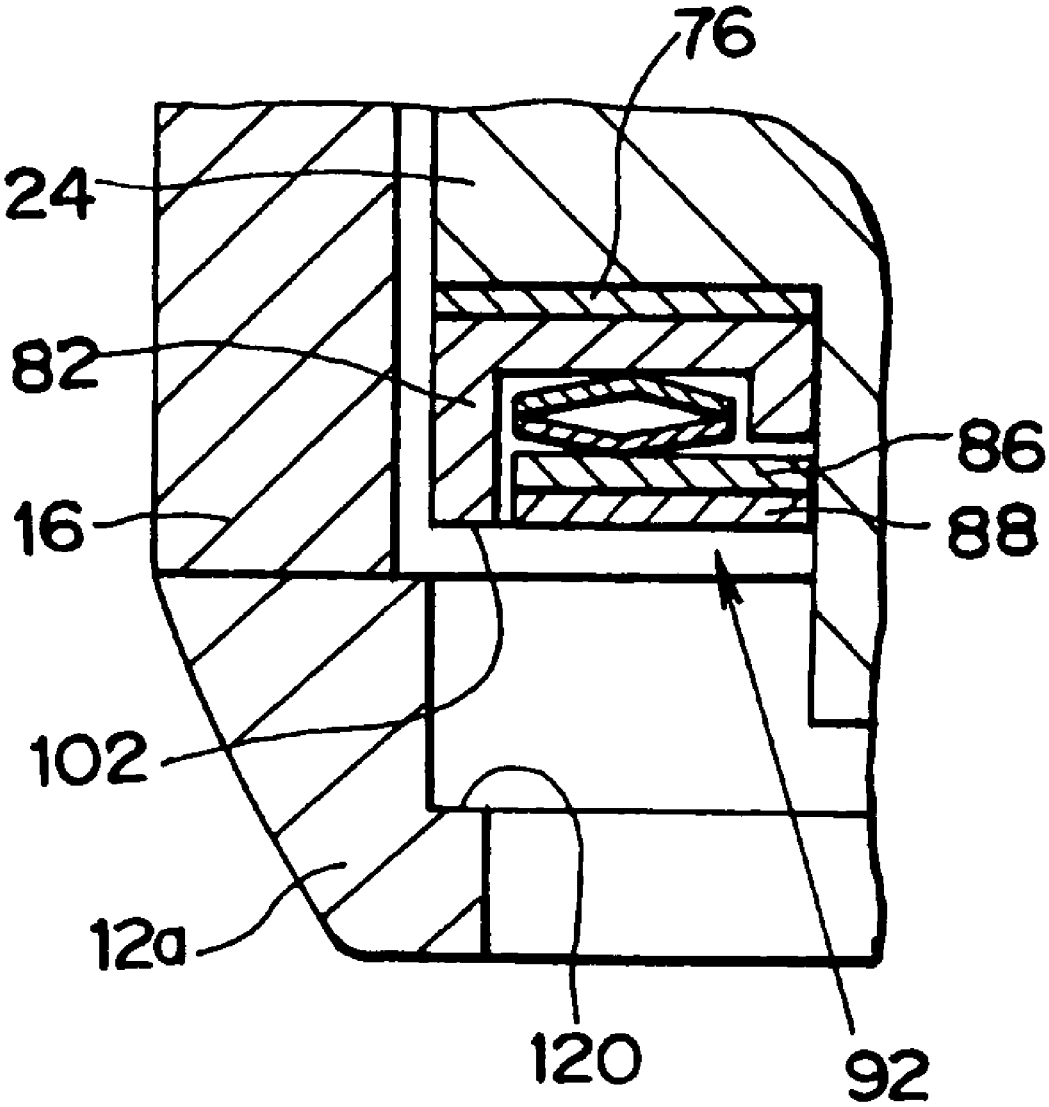
FIG. 9 is a partially sectional view showing a state in which the ratchet wrench of FIG. 7 is assembled.

A third embodiment of the invention will be described below with reference to FIGS. 7 to 9. In FIGS. 7 to 9, the same components as those shown in FIGS. 1 to 4 are designated by the same reference numerals. In the third embodiment, similarly to the first embodiment, the as-prepared material to which the heat treatment is not performed is used as the housing 10 including the first annular hold portion 12*a* and the second annular hold portion 12*b*. The same shank 22A as the first embodiment is used for the shank assembly 94. In the third embodiment, the shank assembly 94 is inserted from the central space 13*b* side of the second annular hold portion 12*b* toward the first annular hold portion 12*a* side with the engagement portion 26 in the lead.

As shown in FIG. 7, an annular recess portion 120 is formed in the inner wall of the first annular hold portion 12*a*, and a substantially-semi-cylindrical fitting recess portion 122 is formed at one point on the rim of the recess portion 120. Similarly to the first embodiment, the third embodiment also includes the frictional force generation means 92 which comprises the first washer 76, the first guide bush 82, the one or plural disc springs 84, the second washer 86, and the third washer 88. In the second annular hold portion 12*b*, an annular groove 126 is formed in an opposing wall 124 facing the second central space 13*b*.

In the case where the shank assembly 94 is attached between the first annular hold portion 12*a* and the second annular hold portion 12*b*, the shank assembly 94 is inserted from the central space 13*b* of the second annular hold portion 12*b* toward the first annular hold portion 12*a* with the engagement portion 26 side in the lead, and the free end-face 102 of the first guide bush 82 of the frictional force generation means 92 is caused to abut on the annular recess portion 120 of the first annular hold portion 12*a* as shown in FIGS. 8 and 9. In the state in which the first guide bush 82 abuts on the annular recess portion 120 of the first annular hold portion 12*a*, the first guide bush 82 is fitted in and held by the annular recess portion 120 of the first annular hold portion 12*a*. The shank 22 is not brought into direct contact with the first annular hold portion 12*a*.

Before the shank assembly 94 is inserted from the second annular hold portion 12*b* toward the first annular hold portion 12*a*, the rotation locking pin 114 is attached to the fitting recess portion 122 of the first annular hold portion 12*a*, and the fitting recess portion 108 of the first guide bush 82 is fitted on the rotation locking pin 114 when the shank assembly 94 is inserted. Therefore, the first guide bush 82 is held to prevent rotation with respect to the first annular hold portion 12*a*, and the shank 22A is in the rotatable state with respect to the first guide bush 82 and the first annular hold portion 12*a*.

In the state in which the free end-face 102 of the first guide bush 82 is caused to abut on the recess portion 120 of the first annular hold portion 12*a*, the second guide bush 64 is placed on the upper surface 38 of the shank 22A, and a fourth washer 128 is placed on the projection 72 in the upper portion of the shank 22 or the second guide bush 64. The projection 72 of the upper surface 38 of the base portion 24 is fitted in the hole 66 of the second guide bush 64. In the second guide bush 64 and the fourth washer 128, the transverse movement is obstructed by the opposing wall 124 of the second annular hold portion 12*b*. Then, a snap ring 130 as the drop-out preventing means is attached to the groove 126 of the second annular hold portion 12*b*. In the state in which the snap ring 130 is attached to the groove 126 of the second annular hold portion 12*b* (FIG. 8), the drop-out of the shank assembly 94 from the central space 13*b* of the second annular hold portion 12*b* to the outside is prevented by the snap ring 130. In the state in which the snap ring 130 is attached to the groove 126 of the second annular hold portion 12*b*, the shank 22A is in the rotatable state with respect to the snap ring 130 and the second annular hold portion 12*b*.

Similarly to the first embodiment, in the third embodiment, the spring imparting the friction to the shank 22A is included inside the shank assembly 94. Since the frictional force generation means 92 is attached to the first annular hold portion 12*a* by the rotation locking pin 114, the shank 22A and the locking pin 90 are rotated with respect to the first annular hold portion 12*a* and the second annular hold portion 12*b* while the frictional force generation means 92 is not rotated with respect to the first annular hold portion 12*a* and the second annular hold portion 12*b*. Thus, the third embodiment fulfils the same function as the first embodiment, so that the third embodiment has the same effect as the first embodiment.

Fourth Embodiment

A fourth embodiment of the invention will be described below with reference to FIGS. 10 and 11.

Figure 10:
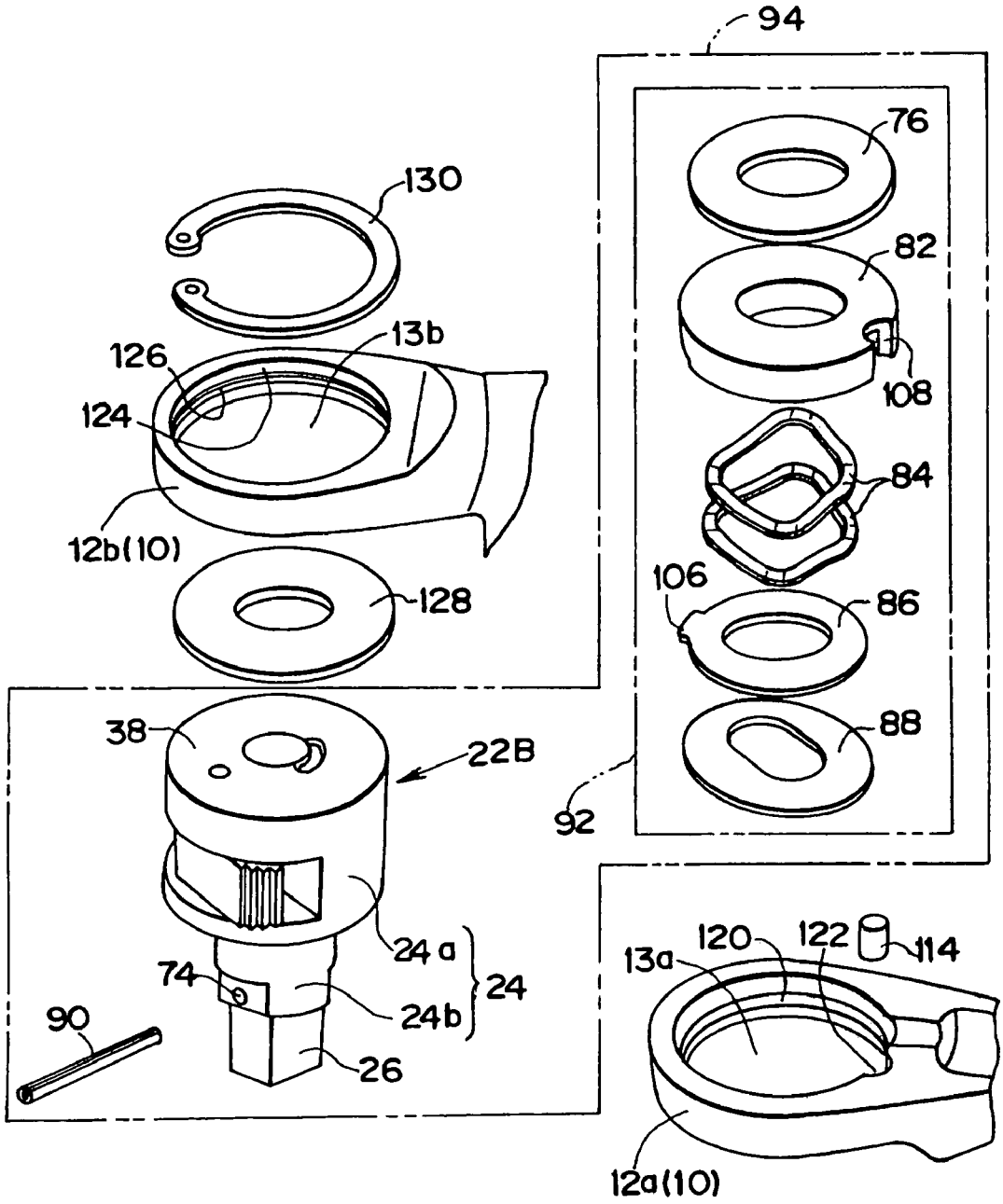
FIG. 10 is an exploded perspective view showing still another embodiment of a ratchet wrench according to the invention.
Figure 11:
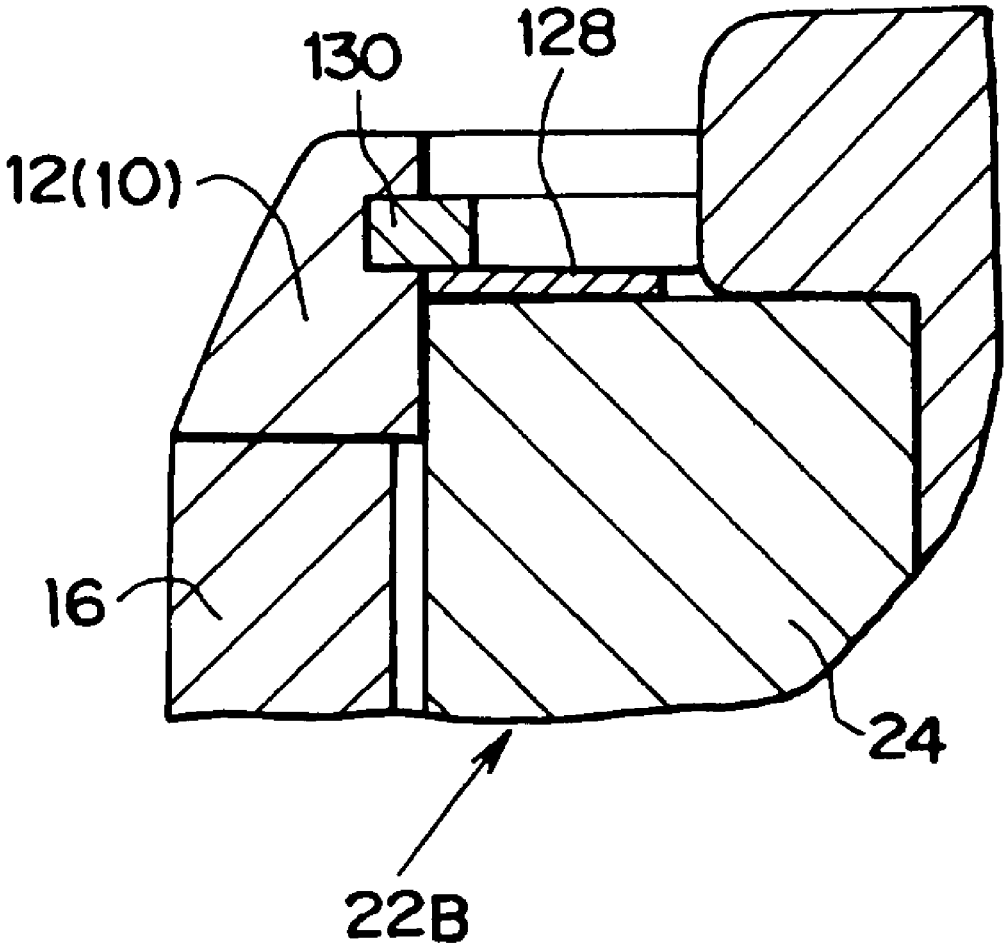
FIG. 11 is a main-part sectional view showing a state in which the ratchet wrench of FIG. 10 is assembled.

In FIGS. 10 and 11, the same components as those shown in FIGS. 1 to 9 are designated by the same reference numerals. The fourth embodiment differs mainly from the third embodiment in that the material to which the heat treatment such as quenching and annealing is performed is used as the housing 10 including the first annular hold portion 12*a* and the second annular hold portion 12*b*. Further, the shank 22B used in the second embodiment is used as the shank. Since the material to which the heat treatment is performed is used as the first annular hold portion 12*a* and the second annular hold portion 12*b*, the second guide bush 64 used in the third embodiment is omitted, and the upper surface 38 of the shank 22B is faced toward the second annular hold portion 12*b* through the fourth washer 128. The fourth washer 128 widens a contact area with the snap ring 130. The fourth embodiment differs from the third embodiment only in the presence or absence of the heat treatment of the housing 10 and the provision of the second guide bush 64. Accordingly, in the fourth embodiment, the same effect as the third embodiment is obtained except for the difference in effect of the heat treatment. Similarly to the second embodiment, in the fourth embodiment, the height of the base portion 24 of the shank 22B is decreased by omitting the second guide bush 64, and the distance between the first annular hold portion 12*a* and the second annular hold portion 12*b* is narrowed. Therefore, the reduction in size and weight of the overall ratchet wrench can be achieved due to the miniaturization of the housing 10.

INDUSTRIAL APPLICABILITY

As described above, according to the ratchet wrench of the invention, the one shank assembly is formed by attaching the frictional force generation means to the shank with the hold means, and the shank assembly is attached between the pair of annular hold portions so as not to drop out. In the invention, since the spring imparting the friction to the shank is included inside the shank assembly, the friction is always kept constant irrespective of the start of the operation, and the conventional drawback that the torque is weakened at the start of the operation can be eliminated. Since the spring force does not have an influence on the pair of annular hold portions, not only can the outward increase in distance between the pair of annular hold portions conventionally generated be prevented, but also a greater degree of freedom of design can be obtained because it is not necessary to consider the distance between the pair of annular hold portions.

According to the ratchet wrench assembly method of the invention, the method is such a simple process that the shank assembly in which the shank, the spring, and the like are assembled is inserted from the central space of one of the annular hold portions toward the other annular hold portion and then the snap ring for preventing the drop-out is attached to one of the annular hold portions. Therefore, the working hours can be shortened to reduce the assembly cost.

The invention claimed is:

1. A ratchet wrench comprising:

a housing including a first annular hold portion and a second annular hold portion spaced apart from said first annular hold portion;

a shank held between said first annular hold portion and said second annular hold portion, said shank including a base portion and a tool-engagement portion connected to said base portion, said base portion comprising a large-diameter portion and a small-diameter portion smaller in diameter than said large-diameter portion;

an annular spring mounted to said housing to impart frictional force to said shank; and a spring-protecting guide member mounted on said shank, said annular spring being mounted in said spring-protecting guide member;

wherein a hold member is secured to said small-diameter portion of said shank and holds said annular spring and said spring-protecting guide member on said shank, such that said annular spring provides a biasing force between said shank and said hold member;

wherein said first annular hold portion has a first central opening therethrough, said first central opening having a size and shape to allow said large-diameter portion of said shank to pass therethrough;

wherein said second annular hold portion has a second central opening therethrough, said second central opening having a size and shape to prevent said large-diameter portion of said shank from passing therethrough, such that said shank is prevented from dropping out of said housing through said second central opening of said second annular hold portion;

wherein said spring-protecting guide member has a central through-hole sized and shaped to allow said tool-engagement portion and said small-diameter portion of said shank to pass therethrough and to prevent said large-diameter portion of said shank from passing therethrough; and wherein a drop-out preventing member is secured to said first annular hold portion and arranged to prevent said shank from dropping out of said housing through said first central opening of said first annular hold portion.

2. A ratchet wrench according to claim 1, wherein said first annular hold portion has a recess formed therein; and an abrasion-preventing member is provided in said recess to obstruct contact between said first annular hold portion and said large-diameter portion of said shank.

3. A ratchet wrench according to claim 2, wherein said abrasion-preventing member has an annular shape with a central hole therethrough; and said large-diameter portion includes a projection fitted in said central hole of said abrasion-preventing member.

4. A ratchet wrench according to claim 2, wherein a rotation-preventing member is provided between said abrasion-preventing member and said first annular hold portion, said rotation-preventing member being arranged to prevent rotation of said abrasion-preventing member with respect to said first annular hold portion.

5. A ratchet wrench according to claim 1, wherein said housing comprises a heat-treated housing;

said first annular hold portion has a recess formed therein; and said large-diameter portion of said shank is fitted in said recess such that said large-diameter portion of said shank directly contacts said first annular hold portion.

6. A ratchet wrench according to claim 1, wherein an annular groove is formed in an inner side wall of said first annular hold portion; and said drop-out preventing member comprises a snap ring secured in said annular groove.

7. A ratchet wrench according to claim 1, wherein a rotation-preventing member is provided between said spring-protecting guide member and said first annular hold portion of said housing to prevent rotation of said spring-protecting guide member with respect to said first annular hold portion.

8. A ratchet wrench according to claim 1, wherein said spring-protecting guide member is formed to include an inner cylindrical wall, and outer cylindrical wall, and an annular end wall spanning between said inner and outer cylindrical walls; and said annular spring is disposed in a space defined between said inner cylindrical wall, said outer cylindrical wall, and said annular end wall of said spring-protecting guide member.

9. A ratchet wrench according to claim 1, further comprising a first washer disposed between said spring-protecting guide member and said large-diameter portion of said shank; and a second washer is disposed between said annular spring and said locking member.

10. A ratchet wrench according to claim 1, wherein said annular spring is constituted by one of an annular wave spring and an annular disc spring.

11. A ratchet wrench according to claim 1, wherein said hold member is configured so as to not protrude outwardly beyond an outer surface of either of said first and second annular hold portions.

12. A ratchet wrench according to claim 11, wherein said hold member comprises a locking pin disposed in a transverse through-hole formed in said base portion of said shank.

* * * * *